US007617100B1

(12) United States Patent
Luo

(10) Patent No.: US 7,617,100 B1
(45) Date of Patent: Nov. 10, 2009

(54) METHOD AND SYSTEM FOR PROVIDING AN EXCITATION-PATTERN BASED AUDIO CODING SCHEME

(75) Inventor: Fa-Long Luo, San Jose, CA (US)

(73) Assignee: NVIDIA Corporation, Santa Clara, CA (US)

( * ) Notice: Subject to any disclaimer, the term of this patent is extended or adjusted under 35 U.S.C. 154(b) by 1278 days.

(21) Appl. No.: 10/340,060

(22) Filed: Jan. 10, 2003

(51) Int. Cl.
*G10L 19/00* (2006.01)

(52) U.S. Cl. ..... 704/230; 704/200.1

(58) Field of Classification Search ..... 704/200.1, 704/229, 230
See application file for complete search history.

(56) References Cited

U.S. PATENT DOCUMENTS

| | | | | |
|---|---|---|---|---|
| 5,623,577 | A * | 4/1997 | Fielder | 704/200.1 |
| 5,943,242 | A | 8/1999 | Vorbach et al. | |
| 6,021,490 | A | 2/2000 | Vorbach et al. | |
| 6,081,903 | A | 6/2000 | Vorbach et al. | |
| 6,119,181 | A | 9/2000 | Vorbach et al. | |
| 6,338,106 | B1 | 1/2002 | Vorbach et al. | |
| 6,405,299 | B1 | 6/2002 | Vorbach et al. | |
| 6,425,068 | B1 | 7/2002 | Vorbach et al. | |
| 6,480,937 | B1 | 11/2002 | Vorbach et al. | |
| 6,542,998 | B1 | 4/2003 | Vorbach et al. | |
| 6,571,381 | B1 | 5/2003 | Vorbach et al. | |
| 6,697,979 | B1 | 2/2004 | Vorbach et al. | |
| 7,003,660 | B2 | 2/2006 | Vorbach et al. | |
| 7,210,129 | B2 | 4/2007 | May et al. | |
| 7,266,725 | B2 | 9/2007 | Vorbach et al. | |
| 7,394,284 | B2 | 7/2008 | Vorbach | |
| 7,434,191 | B2 | 10/2008 | Vorbach et al. | |
| 7,444,531 | B2 | 10/2008 | Vorbach et al. | |
| 2003/0115051 | A1 * | 6/2003 | Chen et al. | 704/230 |
| 2004/0196913 | A1 * | 10/2004 | Chakravarthy et al. | 375/254 |
| 2005/0159946 | A1 * | 7/2005 | Chen et al. | 704/229 |

* cited by examiner

*Primary Examiner*—Angela A Armstrong
(74) *Attorney, Agent, or Firm*—Patterson & Sheridan, LLP

(57) ABSTRACT

An improved audio compression scheme is provided. The scheme uses an excitation pattern to more efficiently provide audio signal compression. Under the scheme, an input signal is transformed to the frequency domain. Next, the excitation pattern corresponding to the transformed input signal is calculated. Bit allocation processing is then performed based on the excitation pattern. Frequencies are then coded based on the results of the bit allocation processing. Finally, bitstream packing is performed to generate the output coded audio bit stream. In one exemplary implementation, the audio compression scheme is implemented in an encoder.

12 Claims, 5 Drawing Sheets

METHOD AND SYSTEM FOR PROVIDING AN EXCITATION-PATTERN BASED AUDIO CODING SCHEME

BACKGROUND OF THE INVENTION

The present invention generally relates to an audio coding scheme and, more specifically, to an improved audio coding scheme that is based on an excitation pattern.

Transmitting audio signals emanating from an audio source in their original form requires a not insignificant amount of computing resources. Furthermore, portions of audio signals are beyond human detection and thus their transmission is wasteful. Consequently, audio signals are typically compressed before they are transmitted. There are usually two approaches to compress audio signals for use in applications such as communications, audio broadcasting and storage systems.

One approach utilizes the redundant nature of audio signals in time-domain and frequency-domain. This approach is used in a number of schemes including, for example, linear prediction schemes and discrete Fourier transform based schemes.

Another approach uses perceptual coding where signal processing characteristics of auditory systems are used to remove data that are irrelevant or inaudible to the auditory systems. One common audio phenomenon that is exploited in current perceptual audio technologies, such as, standard audio codecs AAC or AC3 in DVD, HDTV and digital audio broadcasting, is the masking effect. Masking effect occurs when a fainter but otherwise distinctly audible signal becomes inaudible when a louder signal appears simultaneously. In other words, the fainter signal is masked by the louder signal. The fainter signal is called as the maskee and the louder signal is called as the masker. Masking effect depends on the spectral composition of both the masker and the maskee. One characteristic associated with the masking effect is the masked threshold. All signals under the masked threshold are in effect inaudible and hence can be neglected (or effectively considered to be zero) in audio codecs. FIG. 1 illustrates a typical masking-effect-based audio encoder. This audio encodes includes a number of components which respectively perform the following functions: (1) window-processing; (2) transforming the signal to frequency domain by performing fast Fourier transform or some other orthogonal transforms such as the discrete cosine transform or wavelet transforms; (3) calculating the masked threshold according to rules known from psychoacoustics and the spectrum obtained in (2); (4) performing bit-allocation processing to allocate different bits for different frequency bins according to their magnitudes and the masked threshold, (for example, for all frequency bins whose magnitude are less than the masked threshold, the allocated bit is zero); (5) coding all frequencies with different bits based on the bit allocation calculation; and (6) performing bitstream packing to assemble the bitstream and some additional information, such as, bit allocation information. The foregoing functions of these various components in the masking-effect-based audio encoder are well understood by a person of ordinary skill in the art.

In addition, the audio encoder shown in FIG. 1 can be simplified to create a transform-based encoder. FIG. 2 illustrates a typical transform-based encoder. The transform-based encoder uses a source coding scheme (frequency domain transform source coding scheme). The transform-based encoder is similar to the audio encoder shown in FIG. 1 except that all components related to the masking effect are not included.

Although these available coding techniques can satisfy the bit rate requirements in many applications, further audio compression is still highly desirable in very low bit rate applications. As a matter of fact, in addition to the masking effect, other characteristics of human auditory systems could be employed to achieve the goal of further reducing bit rate.

Hence, it would be desirable to have a method and system that is capable of providing audio compression in a more efficient manner.

BRIEF SUMMARY OF THE INVENTION

An improved audio compression scheme is provided. In one exemplary embodiment, the scheme uses an excitation pattern to more efficiently provide audio signal compression. Under the scheme, an input signal is transformed to the frequency domain. Next, the excitation pattern corresponding to the transformed input signal is calculated. Bit allocation processing is then performed based on the excitation pattern. Frequencies are then coded based on the results of the bit allocation processing. Finally, bitstream packing is performed to generate the output coded audio bit stream. In one exemplary implementation, the audio compression scheme is implemented in an encoder.

Reference to the remaining portions of the specification, including the drawings and claims, will realize other features and advantages of the present invention. Further features and advantages of the present invention, as well as the structure and operation of various embodiments of the present invention, are described in detail below with respect to accompanying drawings, like reference numbers indicate identical or functionally similar elements.

DETAILED DESCRIPTION OF THE INVENTION

The present invention in the form of one or more exemplary embodiments will now be described. In one exemplary method of the present invention, a new audio compression scheme makes use of two characteristics of the human auditory systems, namely, the frequency resolution and the excitation pattern. Unlike masking-effect based audio coding technology used in standard audio codecs such as AAC, AC-3 of MPEG, the exemplary method takes advantage of another perceptual property, the frequency resolution of human auditory systems, for compressing audio signals. By replacing the magnitude spectrum with the excitation pattern, the exemplary method can be applied to any available frequency-domain audio codecs so as to further reduce the bit rate in these codecs.

The exemplary method is now described further details. In order to further compress audio signals and reduce the bit rate, the frequency resolution of the human auditory system is used. The human auditory system has a limited frequency resolution; more specifically, the human auditory system cannot resolve or differentiate between two audio signals whose frequency difference is less than a resolution threshold. In other words, the human auditory system cannot detect certain spectral detail.

Figure 1:
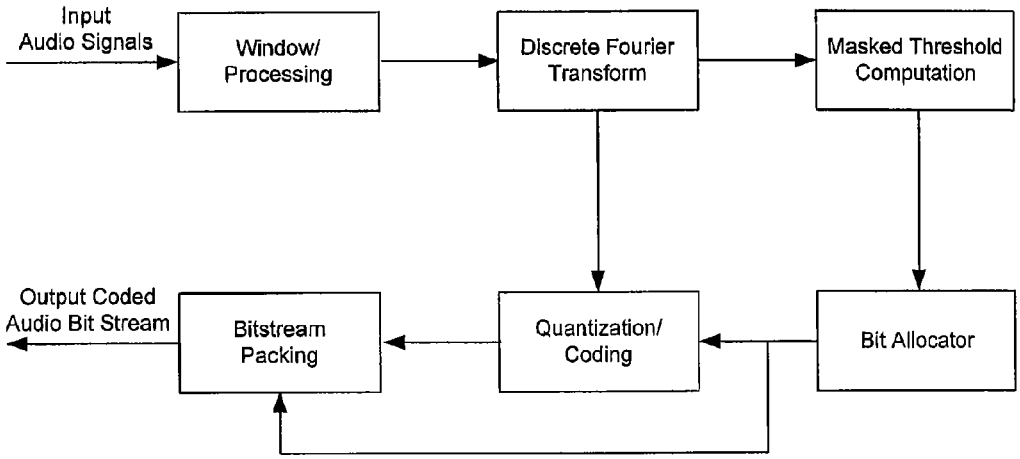
FIG. 1 PRIOR ART
FIG. 1 is a simplified schematic diagram illustrating a typical masking-effect based audio encoder.
Figure 2:
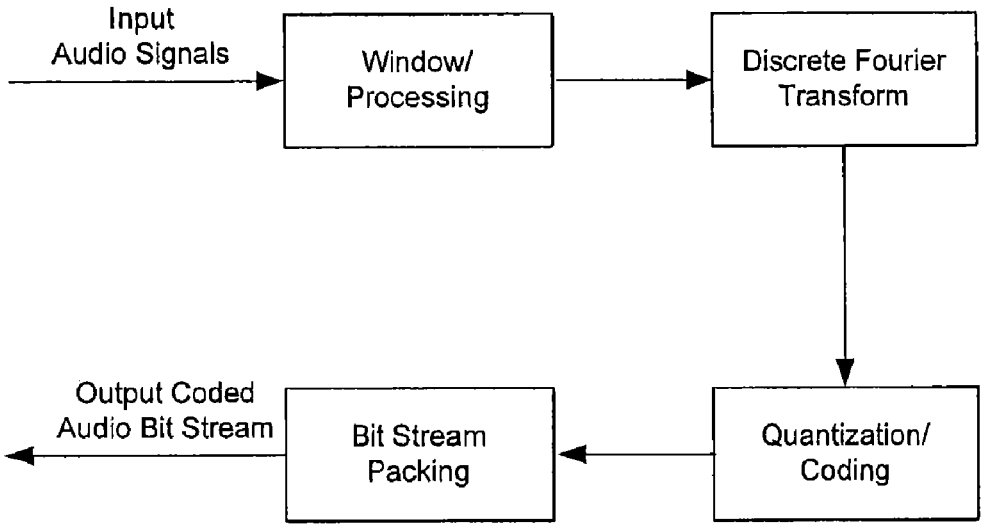
FIG. 2 PRIOR ART
FIG. 2 is a simplified schematic diagram illustrating a typical transform-based encoder.
Figure 3A:
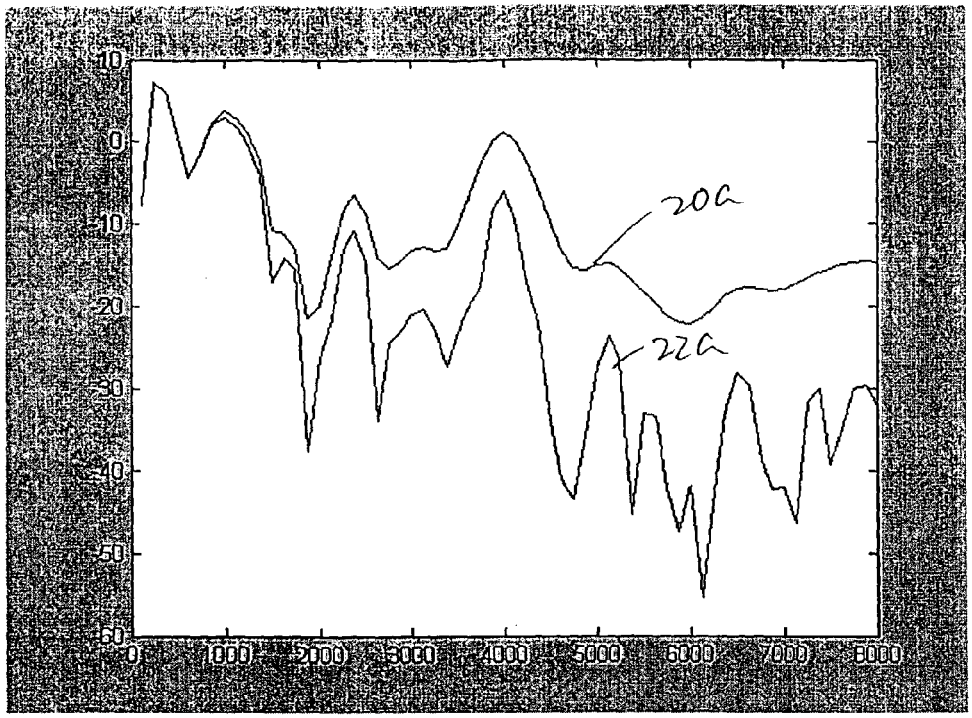
FIGS. 3A and 3B are simplified diagrams illustrating comparisons between the excitation pattern and the magnitude spectrum of audio signals.
Figure 3B:
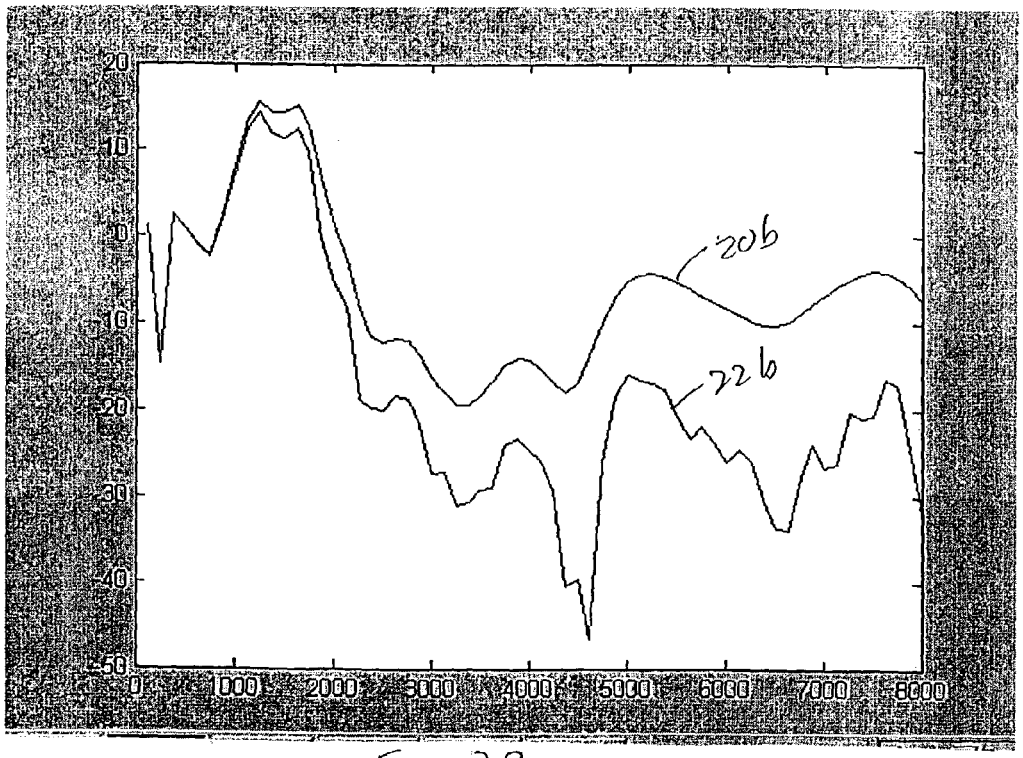

The excitation pattern represents the magnitude of the output of auditory filters in response to an input signal as a function of the filter center frequency. Because the excitation pattern no longer has spectral details that are imperceptible to the human auditory system and the excitation pattern is much flatter than the original magnitude spectrum, additional audio compression and a lower bit rate can be achieved if the magnitude spectra used in FIGS. 1 and 2 are replaced by the corresponding excitation patterns. FIGS. 3A and 3B illustrate comparison results between an excitation pattern and a magnitude spectrum. As shown in FIGS. 3A and 3B, the excitation patterns 20*a* and 20*b* respectively exhibit a flatter nature than the magnitude spectra 22*a* and 22*b*.

Figure 4:
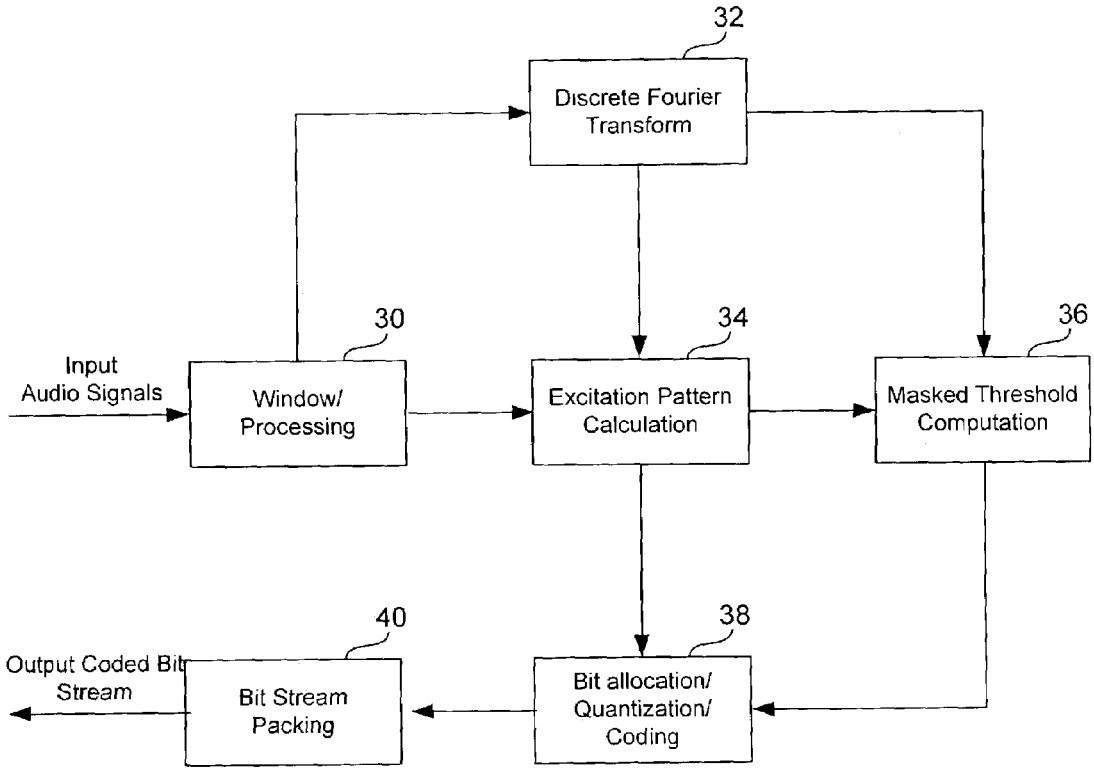
FIG. 4 is a simplified schematic diagram illustrating a first exemplary encoder in accordance with the present invention.

FIG. 4 illustrates the various components of an exemplary encoder in accordance with the present invention. The exemplary encoder uses an excitation-pattern-based audio coding scheme. Referring to FIG. 4, the exemplary encoder performs a number of functions.

At 30 and 32, the input signal is transformed to the frequency domain by performing windowing processing and fast Fourier transform. At 34, the excitation pattern corresponding to the input signal is calculated. This involves calculating the output of an array of simulated auditory filters in response to the magnitude spectrum. Each side of each auditory filter is modeled as an intensity-weighting function. The intensity-weighting function is assumed to have the following form:

$$w(f) = \left(1 + p\frac{|f - f_c|}{f_c}\right)\exp\left(-p\frac{|f - f_c|}{f_c}\right) \tag{1}$$

where $f_c$ is the center frequency of the filter and p is a parameter determining the slope of the filter skirts. The value of p is assumed to be the same for both sides of the filter. The equivalent rectangular bandwidth (ERB) of these filters is $4f_c/p$. According to the definition of ERB, the following equation results:

$$p\frac{f - f_c}{f_c} = \frac{4(f - f_c)}{f_c(0.00000623\ f_c + 0.09339) + 28.52} \tag{2}$$

At 36, the masked threshold is calculated according to rules known from psychoacoustics and the excitation pattern obtained at 34. It should be noted that the magnitude spectrum is replaced by the corresponding excitation pattern when using the known rules to calculate the masked threshold. A person of ordinary skill in the art should be familiar with the rules known from psychoacoustics that are used in calculating the masked threshold.

At 38, bit allocation and quantization processing is performed to allocate different bits for different frequency bins according to their magnitudes of the excitation pattern and the masked threshold. Results from the bit allocation are then used to code all frequencies with different bits. Other coding techniques, such as, Huffman coding could be used as well.

At 40, bitstream packing is performed to assemble the bitstream with additional information, such as, bit allocation information which is needed in the decoder side.

Figure 5:
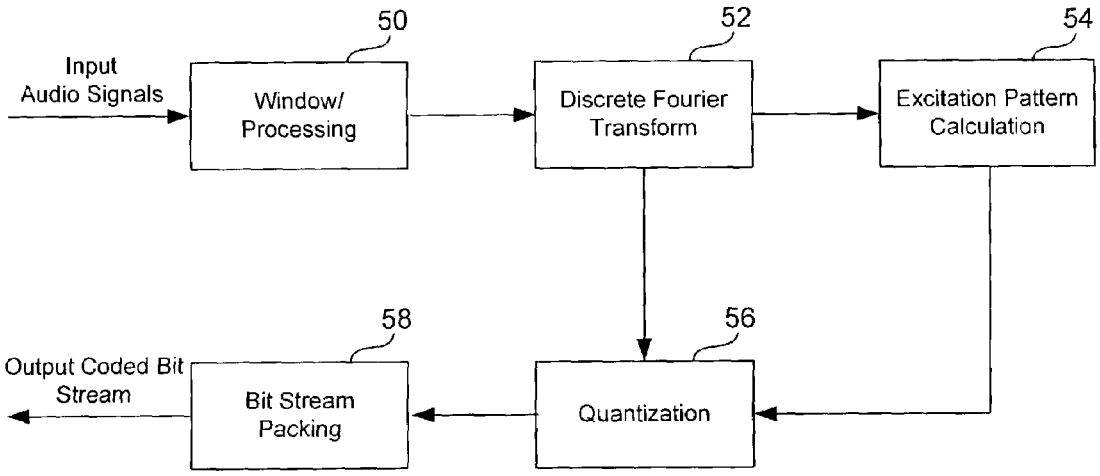
FIG. 5 is a simplified schematic diagram illustrating a second exemplary encoder in accordance with the present invention.

FIG. 5 illustrates another exemplary encoder in accordance with the present invention. This exemplary encoder is similar to the one illustrated in FIG. 4 above. In this other exemplary encoder, the masked threshold is not calculated. Processing or functions performed at 50, 52, 54, 56 and 58 are respectively similar to those performed at 30, 32, 34, 38 and 40 as shown in FIG. 4.

The exemplary encoders described above have decoder counterparts in order to successfully retrieve the compressed audio signals. In the decoder counterpart, there are two options for the inverse processing of the transformation of the input signal and the calculation of the excitation pattern. The first option is to directly perform an inverse fast Fourier transform (IFFT) of the excitation pattern to obtain the decoded audio signals. The second option is first to perform a deconvolution process on the excitation pattern with the auditory filters and then perform the IFFT of the output of deconvolution process to obtain the decoded audio signals. Because the coefficients of all auditory filters are fixed and known on the decoding side, no additional bit rate is needed for these coefficients. This second option provides better quality but the associated cost is the increase of complexity incurred by the deconvolution process. Depending on the particular application, a person of ordinary skill in the art will be able to select the appropriate option to decode the compressed audio signals in accordance with the present invention.

In one exemplary implementation, the present invention is implemented with control logic using computer software in either an integrated or modular manner or hardware or a combination of both. However, it should be understood that based on the disclosure and teachings provided herein, a person of ordinary skill in the art will know of other ways and/or methods to implement the present invention.

In another exemplary implementation, the present invention is implemented in an integrated circuit chip. The integrated circuit chip can be deployed in many applications including, for example, a wireless communication system. A person of ordinary skill in the art will know how to deploy the present invention in other types of applications.

It is understood that the examples and embodiments described herein are for illustrative purposes only and that various modifications or changes in light thereof will be suggested to persons skilled in the art and are to be included within the spirit and purview of this application and scope of the appended claims. All publications, patents, and patent applications cited herein are hereby incorporated by reference for all purposes in their entirety.

What is claimed is:

1. A method for providing audio compression in an encoder, comprising:

transforming an input audio signal into a frequency domain representation to produce a transformed audio input signal;

calculating an excitation pattern representing the magnitude of an output of auditory filters in response to an input signal as a function of filter center frequency corresponding to the transformed input audio signal including replacing a magnitude spectrum of the input audio signal with the corresponding excitation pattern using simulated auditory filters whose sides are modeled as an intensity weighting function;

performing bit allocation and quantization based on the magnitudes of different bits in the excitation pattern, without using a masked threshold, to generate bit-allocation results and quantization results;

coding a plurality of frequencies based on the bit-allocation results; and performing bitstream packing based on the quantization results and coding results to generate a compressed coded audio output signal.

2. The method of claim 1 wherein transforming the input audio signal into the frequency domain further comprises:

using a fast Fourier transform to transform the input audio signal.

3. The method of claim 1 further comprising:

transmitting the coded audio output signal; and performing an inverse transform of the excitation pattern on the coded audio output signal to obtain a decoded audio signal.

4. The method of claim 3 wherein the inverse transform is an inverse fast Fourier transform.

5. The method of claim 1 further comprising:

transmitting the coded audio output signal;

performing a deconvolution process of the excitation pattern to generate a deconvolution process output; and performing an inverse transform of the deconvolution process output to obtain a decoded audio signal.

6. The method of claim 5 wherein the inverse transform is an inverse fast Fourier transform.

7. A system for providing audio compression, comprising:

an integrated circuit chip configured to:

transform an input audio signal into a frequency domain representation to produce a transformed input audio signal;

calculate an excitation pattern representing the magnitude of an output of auditory filters in response to an input signal as a function of filter center frequency corresponding to the transformed input audio signal including replacing a magnitude spectrum of the input audio signal with the corresponding excitation pattern using simulated auditory filters whose sides are modeled as an intensity weighting function;

perform bit allocation and quantization based on the magnitudes of different bits in the excitation pattern, without using a masked threshold, to generate bit-allocation results and quantization results;

code a plurality of frequencies based on the bit-allocation results; and perform bitstream packing based on the quantization results and coding results to generate a compressed coded audio output signal.

8. The system of claim 7 wherein the input audio signal is transformed into the frequency domain further using a fast Fourier transform.

9. The system of claim 7 wherein the integrated circuit chip is further configured to:

perform an inverse transform of the excitation pattern on the coded audio output signal to obtain a decoded audio signal.

10. The system of claim 9 wherein the inverse transform is an inverse fast Fourier transform.

11. The system of claim 7 wherein the integrated circuit chip is further configured to:

perform a deconvolution process of the excitation pattern to generate a deconvolution process output; and perform an inverse transform of the deconvolution process output to obtain a decoded audio signal.

12. The system of claim 11 wherein the inverse transform is an inverse fast Fourier transform.

* * * * *